US007438644B2

(12) United States Patent
Gubitosi et al.

(10) Patent No.: US 7,438,644 B2
(45) **Date of Patent: *Oct. 21, 2008**

(54) FREE-STANDING JUMPING DEVICE

(75) Inventors: Domenic T. Gubitosi, East Aurora, NY (US); Brian S. Kelly, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 314 days.

This patent is subject to a terminal disclaimer.

(21) Appl. No.: 11/209,036

(22) Filed: Aug. 23, 2005

(65) Prior Publication Data

US 2006/0186716 A1 Aug. 24, 2006

Related U.S. Application Data

(63) Continuation of application No. 10/772,338, filed on Feb. 6, 2004, now Pat. No. 6,932,709.

(51) Int. Cl.
*A63G 9/12* (2006.01)

(52) U.S. Cl. ..... 472/118; 297/274

(58) Field of Classification Search ..... 472/118–125; 297/273, 16.1, 274, 275; 482/69, 77, 78
See application file for complete search history.

(56) References Cited

U.S. PATENT DOCUMENTS

| | | | |
|---|---|---|---|
| 131,349 | A | 9/1872 | Holmes |
| 616,697 | A | 12/1898 | Cowles et al. |
| 707,774 | A | 8/1902 | Blackledge |
| 1,326,921 | A | 1/1920 | Dzimitowicz |
| 1,806,454 | A | 5/1931 | Goudeau |
| 1,931,567 | A | 10/1933 | Arends |
| 1,950,042 | A | 3/1934 | Upper |
| 2,006,492 | A | 7/1935 | Van Santen |
| 2,282,086 | A | 5/1942 | Peltier |
| D137,437 | S | 3/1944 | Driscoll |
| 2,347,754 | A | 5/1944 | Shay |
| 2,521,422 | A | 9/1950 | Strand, Jr. et al. |
| 2,855,023 | A | 10/1958 | Mekeel et al. |
| 3,029,551 | A | 4/1962 | Reiskin |
| 3,462,113 | A | 8/1969 | MacLeod |
| 3,747,596 | A | 7/1973 | Mills |
| 3,765,674 | A | 10/1973 | Siler |
| 3,796,430 | A | 3/1974 | Sudo |
| 3,992,023 | A | 11/1976 | Moorer |
| 4,025,083 | A | 5/1977 | Saint |
| 4,045,045 | A | 8/1977 | Boucher et al. |

(Continued)

FOREIGN PATENT DOCUMENTS

| | | |
|---|---|---|
| CA | 497983 | 12/1953 |

(Continued)

*Primary Examiner*—Kien Nguyen
(74) *Attorney, Agent, or Firm*—Cooley Godward Kronish LLP

(57) ABSTRACT

A support frame having a first end frame portion having an apex, a second end frame portion having an apex and spaced laterally from the first frame portion, and a ground-engaging portion coupled to each of the end frame portions is disclosed. A plurality of resilient members connect a seat to the frame, each running from the seat to a point on one of the end frame portions below the apex. The seat is suspended from the end frame portions.

20 Claims, 10 Drawing Sheets

U.S. PATENT DOCUMENTS 4,094,547 A 6/1978 Zampino et al.
4,140,311 A 2/1979 Murakami
4,141,095 A 2/1979 Adachi
4,171,132 A 10/1979 Kassai
4,171,847 A 10/1979 Tukui
4,225,146 A 9/1980 Takeuchi
4,231,582 A 11/1980 Moss
4,298,228 A 11/1981 Zampino et al.
4,359,045 A 11/1982 Cozzi
4,359,242 A 11/1982 Gerken et al.
4,364,576 A 12/1982 Kassai
4,553,786 A 11/1985 Locket, III et al.
4,576,392 A 3/1986 Quinlan, Jr.
4,615,523 A 10/1986 Chen
4,699,392 A 10/1987 Ku
4,822,030 A 4/1989 Cone
4,948,120 A 8/1990 Krueger et al.
5,052,749 A 10/1991 Groenendijk
5,054,851 A 10/1991 Chiu
D327,777 S 7/1992 Tepper
5,156,176 A 10/1992 Doorenbos
5,172,955 A 12/1992 Freese et al.
5,201,693 A 4/1993 Sparkes
5,207,478 A 5/1993 Freese et al.
5,407,246 A 4/1995 Meeker et al.
5,451,093 A 9/1995 Petrie et al.
5,490,711 A 2/1996 Pollock
D376,052 S 12/1996 Cone et al.
D378,554 S 3/1997 Meeker et al.
5,615,428 A 4/1997 Li
5,645,489 A 7/1997 Laiche et al.
5,688,211 A 11/1997 Myers
5,690,383 A 11/1997 Meeker
5,700,201 A 12/1997 Bellows et al.
5,704,576 A 1/1998 Meeker et al.
5,704,882 A 1/1998 Coates et al.
5,728,030 A 3/1998 Hsieh et al.
D395,467 S 6/1998 Beloow
5,857,944 A 1/1999 Cone et al.
5,868,459 A 2/1999 Welsh, Jr.
5,876,311 A 3/1999 Coates et al.
5,934,747 A 8/1999 Garland
5,975,628 A 11/1999 Russell
6,030,039 A 2/2000 Essler
6,036,604 A 3/2000 Klitsner
6,048,290 A 4/2000 Chen et al.
6,170,840 B1 1/2001 Mathias
6,179,376 B1 1/2001 Meeker et al.
6,244,606 B1 6/2001 Yang
6,299,247 B1 10/2001 Meeker et al.
6,383,085 B1 5/2002 Tseng
6,520,862 B1 2/2003 Armbruster et al.
6,540,579 B1 4/2003 Gubitosi et al.
6,648,411 B2 11/2003 Julien
2002/0002741 A1 1/2002 Tomas et al.
2002/0027382 A1 3/2002 Bellows et al.
2002/0043824 A1 4/2002 Bellows et al.
2002/0043825 A1 4/2002 Bellows et al.
2002/0115535 A1 8/2002 Stern et al.
2002/0164917 A1 11/2002 Keegan et al.
2003/0020317 A1 1/2003 Keegan et al.
2003/0222421 A1 12/2003 Myers et al.
2004/0119258 A1 6/2004 Yoo

FOREIGN PATENT DOCUMENTS

DE 3304443 A1 8/1984

FREE-STANDING JUMPING DEVICE

CROSS-REFERENCE TO RELATED APPLICATIONS

This application is a Continuation of U.S. patent application Ser. No. 10/772,338, entitled "Free-Standing Jumping Device," filed Feb. 6, 2004 now U.S. Pat. No. 6,932,709, which is incorporated herein by reference in its entirety.

BACKGROUND

The invention relates to children's activity toys, and more particularly to children's jumpers and free-standing jumpers.

There are numerous children's activity devices that are useful to entertain and stimulate children while providing some level of gross motor development. Swings, jumpers, bouncers and other similar devices are designed to keep a child entertained and stimulated in a safe location. Some of these devices can be cumbersome, difficult to store, and may not be adjustable to children of different sizes.

Conventional jumpers can be attached to a frame or suspended from an available structure, such as a doorframe. Suspension jumpers that are attachable in doorways can impede movement of others through the doorway. Additionally, suitable doorframes are not always available or convenient. Moreover, such devices may be less secure than desirable for some caretakers.

Some jumpers with support frames can be difficult to transport, and can be difficult for parents to find a convenient place to store them when not in use. These jumpers can also be difficult or impossible to adjust to children of different sizes.

Thus, there is a need for a device that can be easily stored and moved. Also, a need exists for a jumper that is free-standing and easily adjustable with a stable base.

SUMMARY OF THE INVENTION

The invention includes a support frame having a first end frame portion with an apex, a second end frame portion having an apex and spaced laterally from the first frame portion, and a ground-engaging portion coupled to each of the end frame portions. The invention further includes resilient members configured to couple a seat to the frame, each running from the seat to a point below the apex on one of the end frame portions. The seat is suspended from the end frame portions.

In embodiments of the invention, the device can include height adjustment mechanisms, and a collapsible frame. The height adjustment mechanisms can adjust various components of the frame, resilient members and seat. The collapsible frame can collapse in several different ways.

These and other aspects of the invention will become apparent from the following drawings and description.

BRIEF DESCRIPTION OF THE DRAWINGS

The invention is described with reference to the accompanying drawings. In the drawings, like reference numbers indicate similar elements.

DETAILED DESCRIPTION

Several embodiments of a children's entertainment device or toy incorporating the principles of the invention are shown in FIGS. 1-15. A general description of the device is presented first, followed by a description of various implementations.

Figure 1:
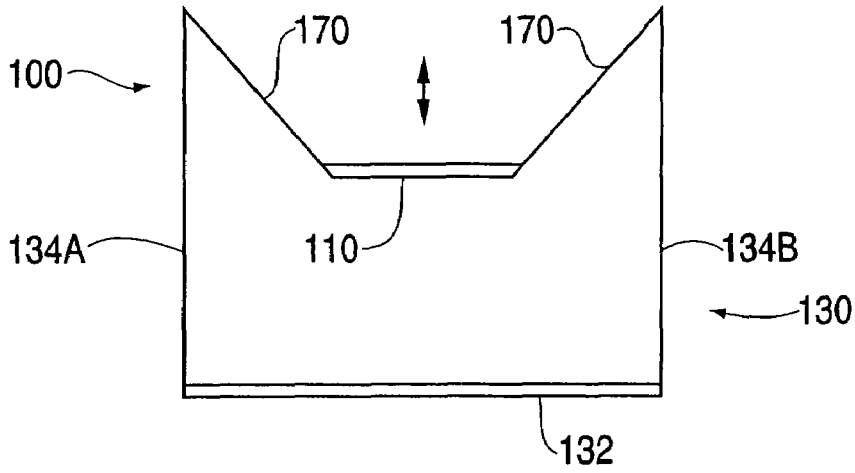
FIG. 1 is a schematic illustration of a generic embodiment of a device incorporating the principles of the invention.
Figure 2:
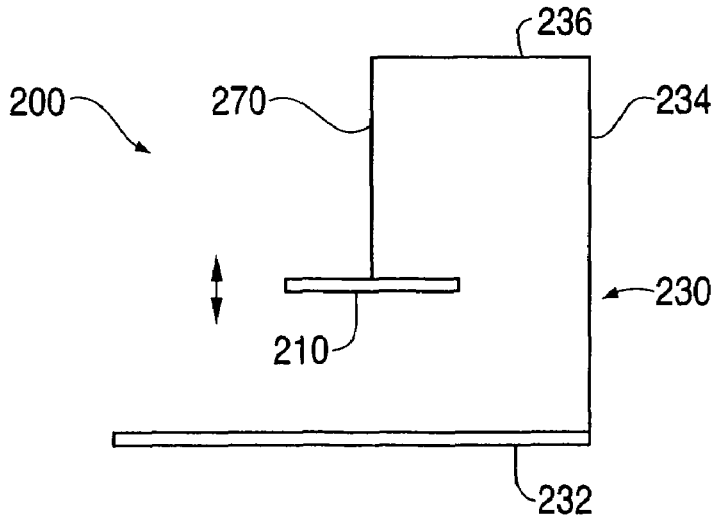
FIG. 2 is a schematic illustration of a further generic embodiment of a device incorporating the principles of the invention.

FIGS. 1 and 2 are schematic illustrations of generic embodiments of the relationship of various components of devices 100, 200. In the embodiment illustrated in FIG. 1, device 100 includes a seat 110, a frame 130, and resilient members 170 coupling seat 110 to frame 130. Frame 130 includes base member 132 and two upright members 134A, 134B. Seat 110 is suspended by resilient members 170 between and by upright members 134A, 134B of frame 130.

In the embodiment illustrated in FIG. 2, device 200 includes seat 210, frame 230, and at least one resilient member 270. Frame 230 includes base member 232, vertical support 234, and overhead support 236. Seat 210 is suspended by resilient member 270 from overhead support 236 of frame 230.

Seats 110, 210 of each of the embodiments illustrated in FIGS. 1 and 2, and other embodiments described herein, are configured to move (i.e., oscillate, reciprocate, etc.) when a vertical force is applied. Thus, a child sitting on the seat 110, 210 can repeatedly bounce upward and downward by either pushing against a surface supporting the device 100, 200 such as a floor, or otherwise allow themselves to drop towards the support surface. To allow children of different ages and sizes to enjoy device 100, 200, the distance between seat 110, 210 and a support surface can be adjusted by changing the length and/or height of different members of frame 130, 230 or resilient members 170, 270.

In each of the embodiments of the invention, the seat is spaced from the frame such that a child in the seat does not contact a frame member when positioned in the seat. Additionally, the frame has a sufficiently wide base (i.e., footprint) and the seat is attached to the frame such that the device or seat is difficult or impossible for the child to overturn.

One implementation of the device discussed above is now described with reference to FIGS. 3-11. Device 300 includes a continuous loop frame 330, and resilient members 370A, 370B, 371A, 371B configured to suspend an infant support 310 from frame 330. Frame 330 includes several components that form two upright, substantially A-shaped portions 334A, 334B. The top of each A-shaped portion 334A, 334B defines an apex 238A, 238B, respectively. The components of frame 330 are described in greater detail below. The A-shaped portions 334A, 334B are spaced laterally from and opposite one another and are coupled by a front base member 332 and a rear base member 333.

Figure 3:
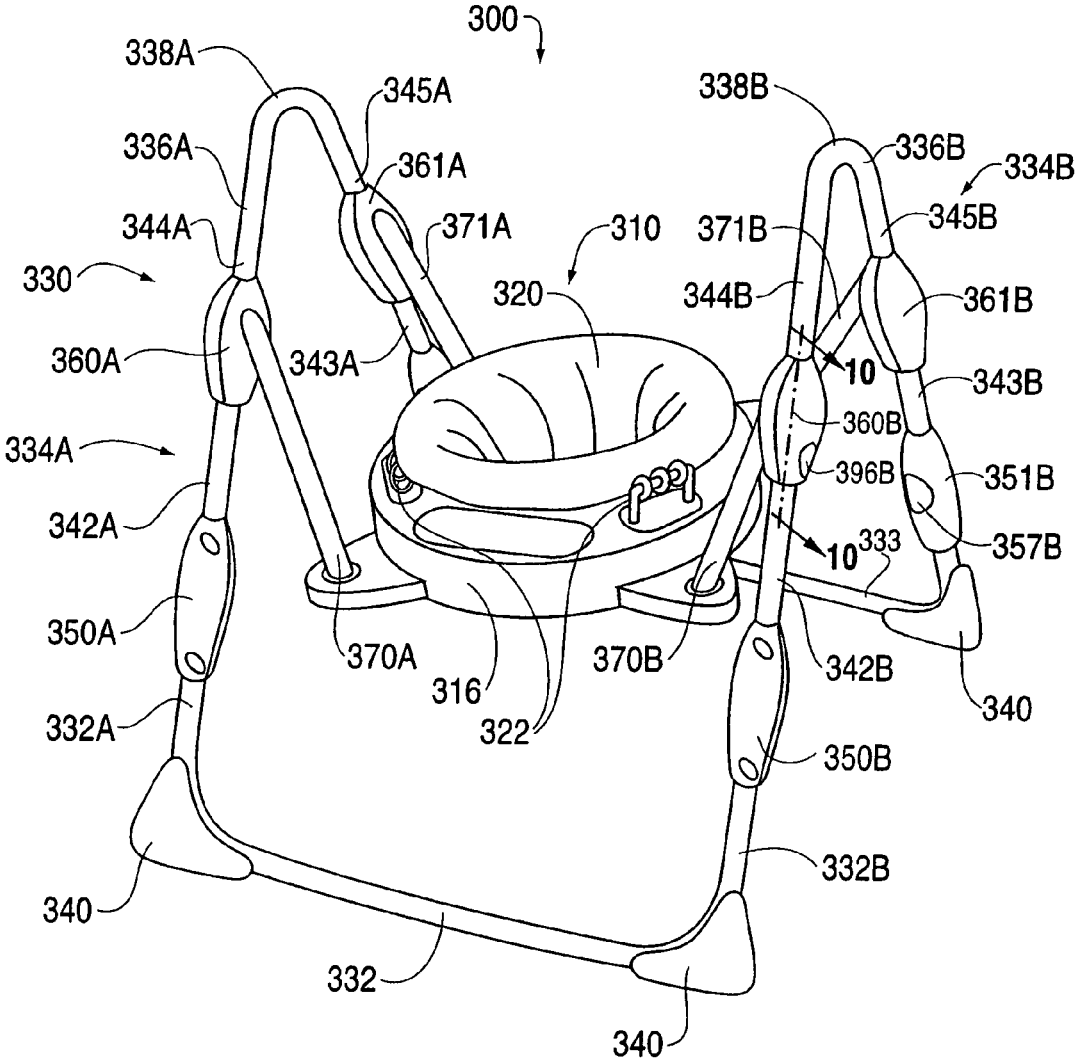
FIG. 3 is a perspective view of a further embodiment of the device of the invention.
Figure 4:
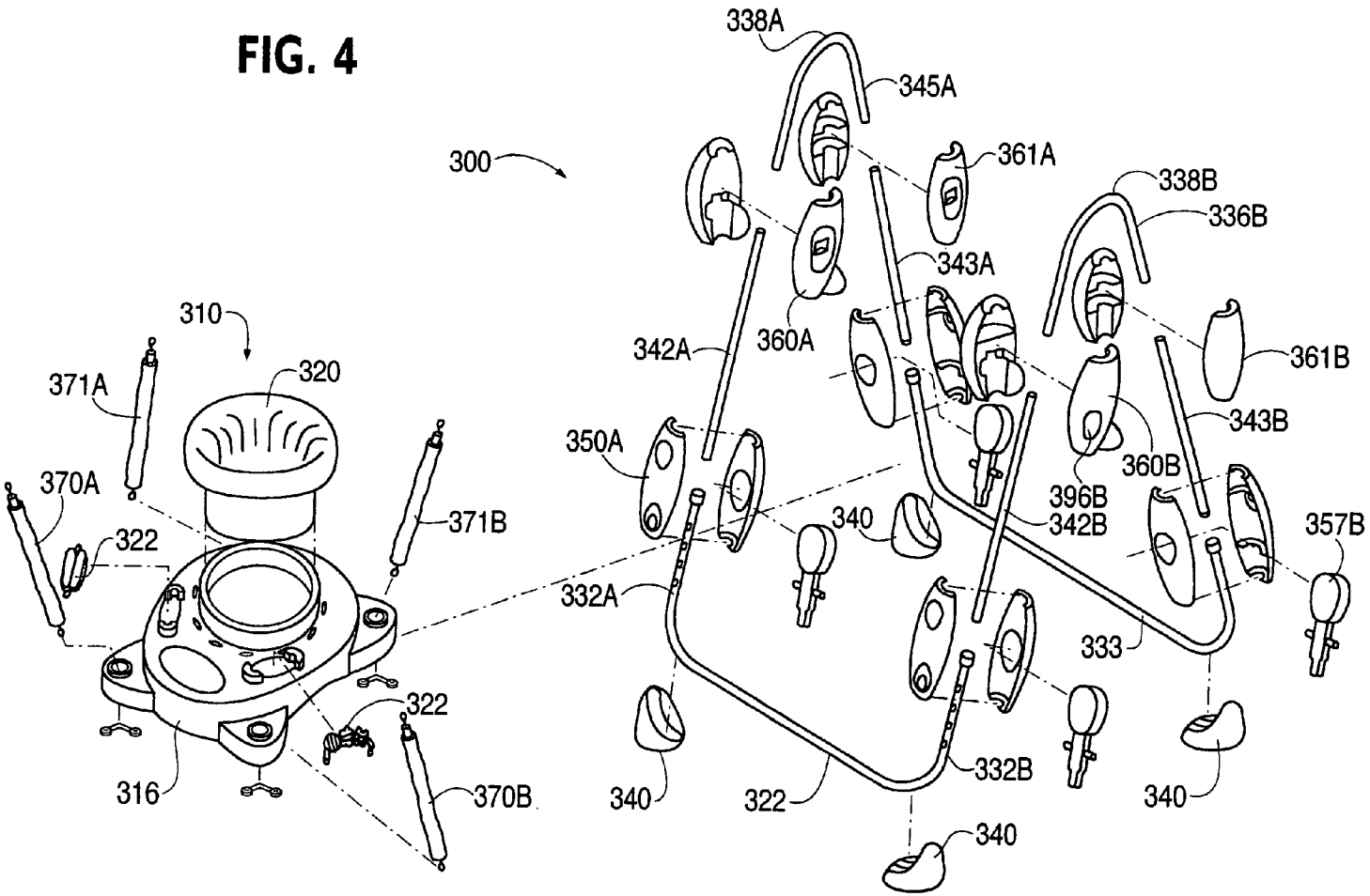
FIG. 4 is an exploded, perspective view of the device illustrated in FIG. 3.
Figure 5:
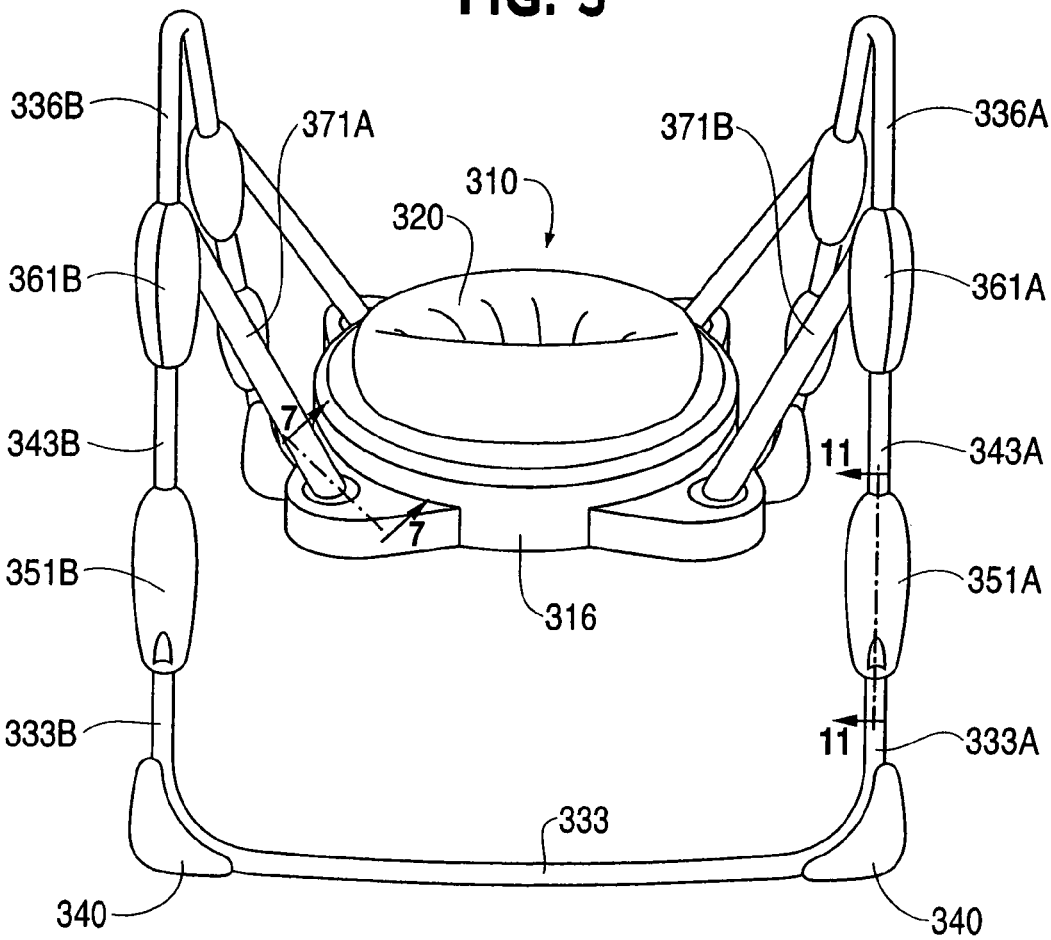
FIG. 5 is a rear view of the device illustrated in FIG. 3.

As shown in FIGS. 3-5, frame 330 includes front base member 332 and rear base member 333. Front base member 332 is substantially U-shaped and includes feet 340 attached at the ground-engaging comers of the U-shape. Rear base member 333 is similarly configured with feet 340. Feet 340 are configured to substantially contact a support surface when the device 300 is in a deployed configuration. Feet 340 are slip-resistant to help maintain device 300 in a desired location. Feet 340 are plastic or rubber but can be made of other suitable materials. Feet 340 can also have additional slip-resistant pads at the point where feet 340 contact the support surface.

Front base member 332 has a first end 332A and a second end 332B. First end 332A is slidably and adjustably coupled to first front mid member 342A through height adjustment mechanism 350A. Similarly, second end 332B is slidably and adjustably coupled to second front mid member 342B through height adjustment mechanism 350B. Rear base member 333 has a similar relationship with rear mid members 343A, 343B and height adjustment mechanisms 351A (not illustrated in FIG. 1), 351B. The operation of height adjustment mechanisms 350A, 350B, 351A, 351B is described in further detail below.

Front mid members 342A, 342B are pivotably coupled to front resilient member connectors 360A, 360B, respectively. Rear mid members 343A, 343B are fixedly coupled to rear resilient member connectors 361A, 361B, respectively. Resilient member connectors 360A, 360B, 361A, 361B are described in further detail below.

First top member 336A is coupled to resilient member connectors 360A, 361A, completing upright A-shaped portion 334A, with front portion 344A of first top member 336A being coupled to first front resilient member connector 360A and the rear portion 345A of first top member 336A being coupled to first rear resilient member connector 361A. Apex 338A is located at the top of first top member 336A, between and above resilient member connectors 360A, 361A. Similarly, second top member 336B is coupled to resilient member connectors 360B, 361B, with front portion 344B of second top member 336B being coupled to second front resilient member connector 360A and the rear portion 345B of second top member 336B being coupled to second rear resilient member connector 361B, with apex 338B located between and above resilient member connectors 360B, 361B.

Figure 6:
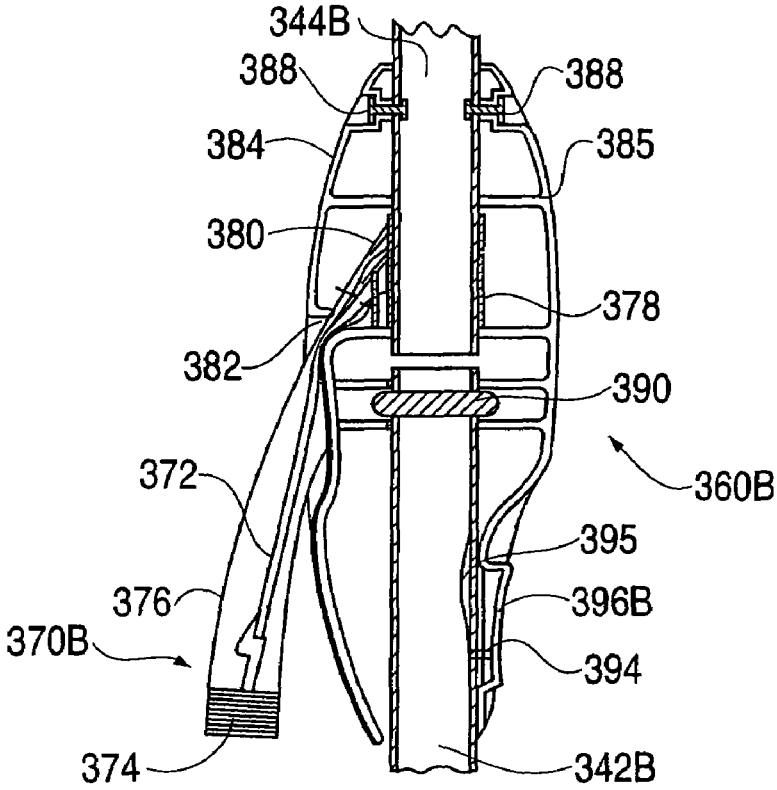
FIG. 6 is a cross-sectional view of a resilient member connector of the device illustrated in FIG. 3, taken along line 6-6 in FIG. 8.

Resilient members 370A, 370B, 371A, 371B are coupled to resilient member connectors 360A, 360B, 361A, 361B, respectively. The following description of resilient member 370B and its connection with resilient member connector 360B, as illustrated in FIG. 6, is representative of each of the remaining resilient members 370A, 371A, 371B and their connection with corresponding resilient member connectors 360B, 361A, 361B, respectively. Resilient member 370B includes connection strap 372, spring 374. A cover 376 is provided to cover the resilient member 370B and to prevent pinch points in spring 374 from being exposed as resilient member 370B expands and contracts when infant support 310 moves. Cover 376 is fabricated from a material sufficiently thick to prevent pinching, but pliable enough to expand and contract with spring member 374 during movement of infant support 310. Suitable materials for cover 376 include plastic, leather, nylon, rubber, and other like materials.

Upper attachment 378 of connection strap 372 and upper attachment 380 of cover 376 are wrapped and secured around front portion 344B of second top member 336B. Cover 376 covers connection strap 372 inside of resilient member connector 360B inside the resilient member connector 360B as well as outside of the connector 360B such that the cover 376 is not readily removable. The connection strap 372 and cover 376 extend through strap access aperture 382. Connection strap 372 is coupled to spring 374 at a location outside of the resilient member connector 360B.

Each remaining resilient member 370A, 371A, 371B is attached to its respective resilient member connector 360A, 361A, 361B in the same manner described above for resilient member 370B and resilient member connector 360B. The attachment of each of the resilient members 370A, 370B, 371A, 371B to infant support 310 is discussed below with reference to resilient member 370A.

Figure 7:
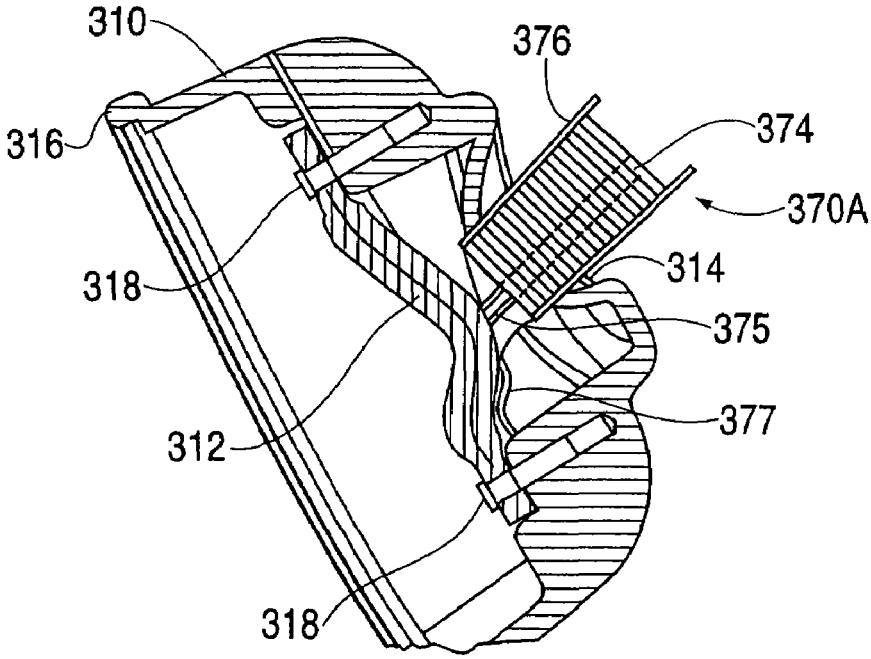
FIG. 7 is a cross-sectional view of the seat attachment of the device illustrated in FIG. 3, taken along line 7-7 in FIG. 5.

As illustrated in FIG. 7, resilient member 370A includes spring 374 and cover 376. Lower attachment 375 of spring 374 is coupled to a pin 312 of infant support 310 through aperture 314. Pin 312 is coupled to tray 316 of infant support 310 with fasteners 318. Lower attachment 375 of spring 374 and lower attachment 377 of cover 376 are wrapped around pin 312, securing resilient member 370A to infant support 310. Each remaining resilient member 370B, 371A, 371B is attached to infant support 310 in a similar manner as resilient member 370A described above.

Referring again to FIGS. 3-5, infant support 310 includes a tray 316 supporting a soft goods seat 320. Various toys 322 are attached to tray 316. Seat 320 is made of a padded material suitable for comfortable seating of an infant or a child while using device 300. Seat 320 can be coupled to tray 316 using various means. Seat 320 can be rotatably coupled to tray 316 to allow an occupant to securely spin within tray 316, or fixedly coupled with fasteners such as hook and loop fasteners, snaps, hooks, etc. Seat 320 can also be removably coupled to tray 316. Seat 320 can be coupled to tray 316 via a rigid or semi-rigid frame assembly (not shown).

Figure 8:
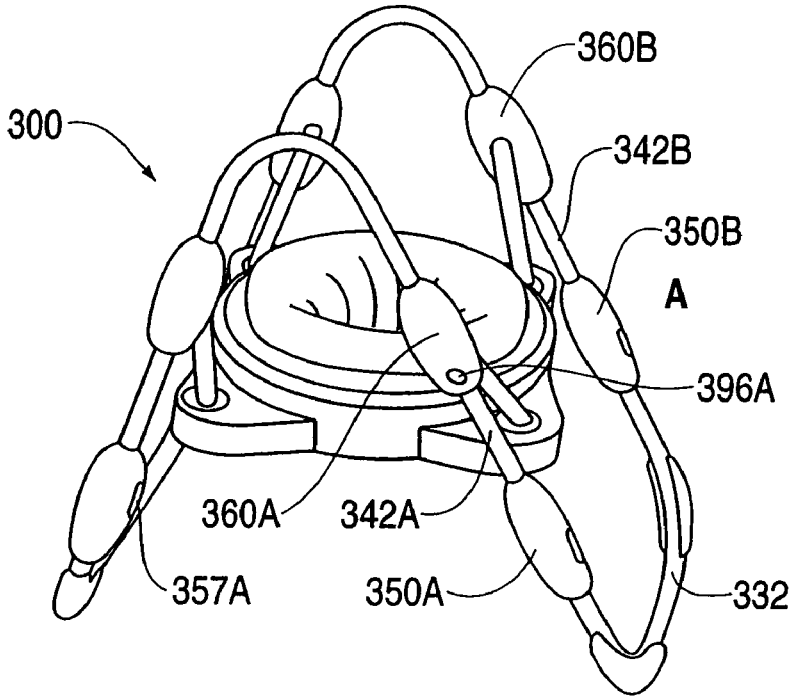
FIG. 8 is a perspective view of the device illustrated in FIG. 3 in a first configuration.
Figure 9:
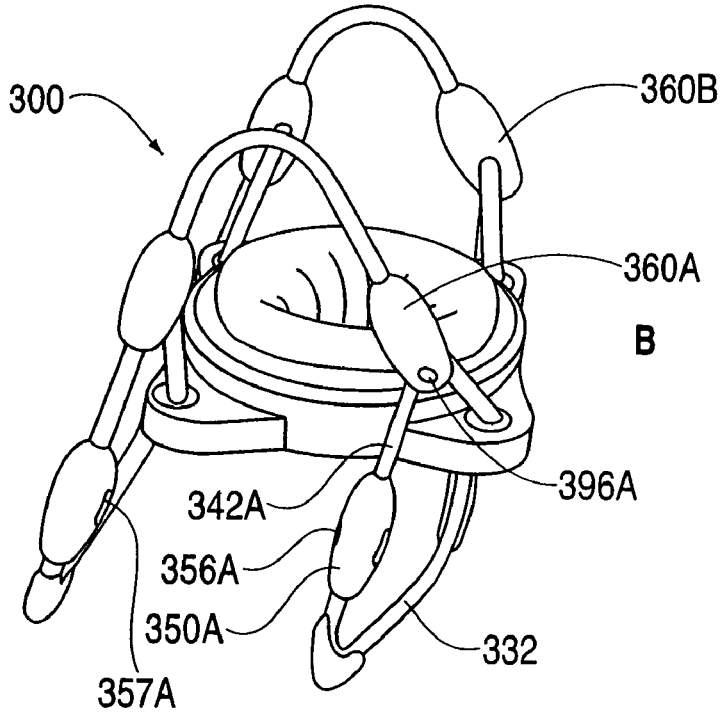
FIG. 9 is a perspective view of the device illustrated in FIG. 3 in a second configuration.

FIGS. 8 and 9 show device 300 in an expanded or extended configuration and a collapsed configuration, respectively. As shown in FIG. 9, the portion of frame 330 including front base member 332 and mid members 342A, 342B, is configured to pivot at resilient member connectors 360A, 360B.

Figure 10:
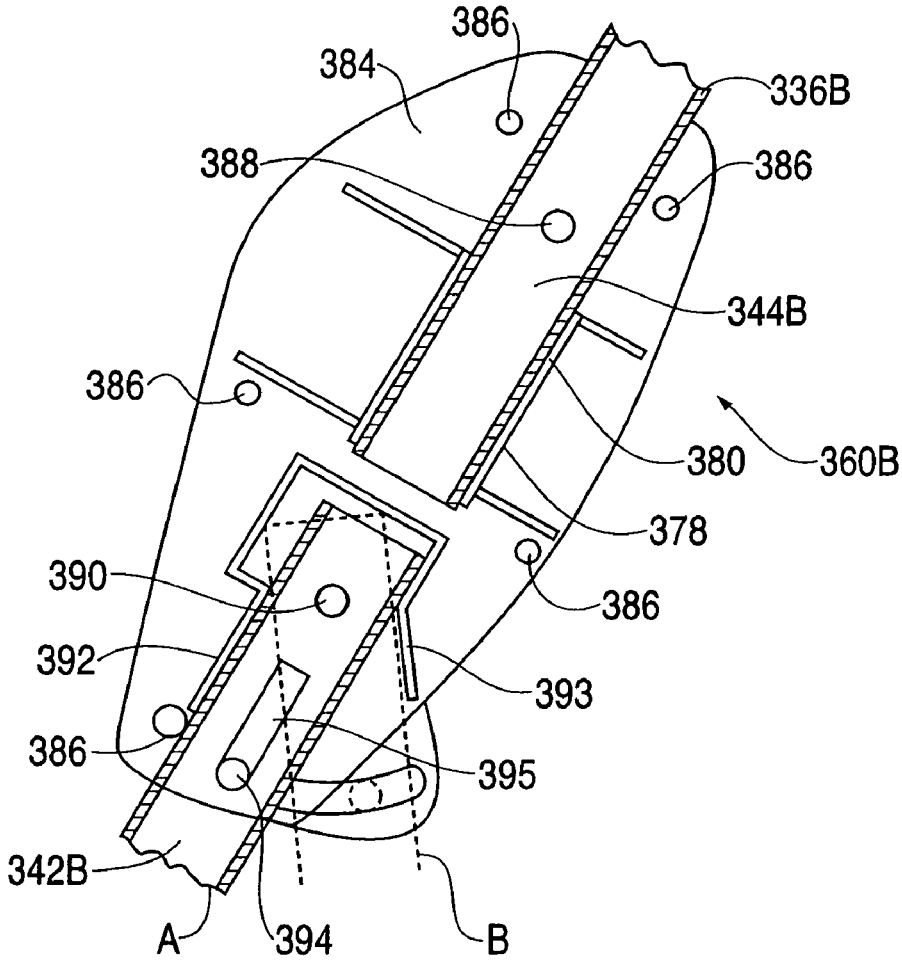
FIG. 10 is a cross-sectional view of the front resilient member connector of the device of FIG. 3, taken along line 10-10 of FIG. 3.

FIGS. 6 and 10 are different cross-sectional views of resilient member connector 360B and detail the pivot connection in resilient member connector 360B, which is representative of the function of resilient member connector 360A. Resilient member connector 360B has a first half 384 and a second half 385. First half 384 and second half 385 are coupled together with fasteners 386, with front portion 344B of upper frame member 336B and second front mid member 342B disposed within resilient member connector 360B between the first half 384 and second half 385.

Front portion 344B of upper frame member 336B is fixedly coupled to resilient member connector 360B with fasteners 388. Second front mid member 342B is pivotably coupled to resilient member connector 360B at pin 390. Stops 392, 393 define a range of motion allowed by second front mid member 342B between the extended configuration and the collapsed configuration (represented by dashed lines in FIG. 10). Second front mid member 342B is held in the extended configuration with a spring-loaded pin 394. Pin 394 engages an aperture in second front mid member 342B and second half 385 to lock second front mid member 342B in the extended configuration. Pin 394 is biased in an engaged position by leaf spring 395. When a release button 396B is pressed, pin 394 is depressed into second front mid member 342B, allowing second front mid member 342B to pivot into the collapsed configuration. Second front mid member 342B pivots in resilient member connector 360B about pin 390 until it contacts stop 393. To return frame 330 to the extended configuration, second front mid member 342B is rotated back towards stop 392 until pin 394 engages resilient member connector 360B, thereby locking frame 330 into the extended configuration.

Both release buttons 396A, 396B on resilient member connectors 360A, 360B must be released for frame 330 to move from the extended configuration to the collapsed configuration. Frame 330 can be held in the collapsed configuration with straps, an additional lock location for pins 394, a detent in the frame 300 or connectors or other similar locking devices.

Figure 11:
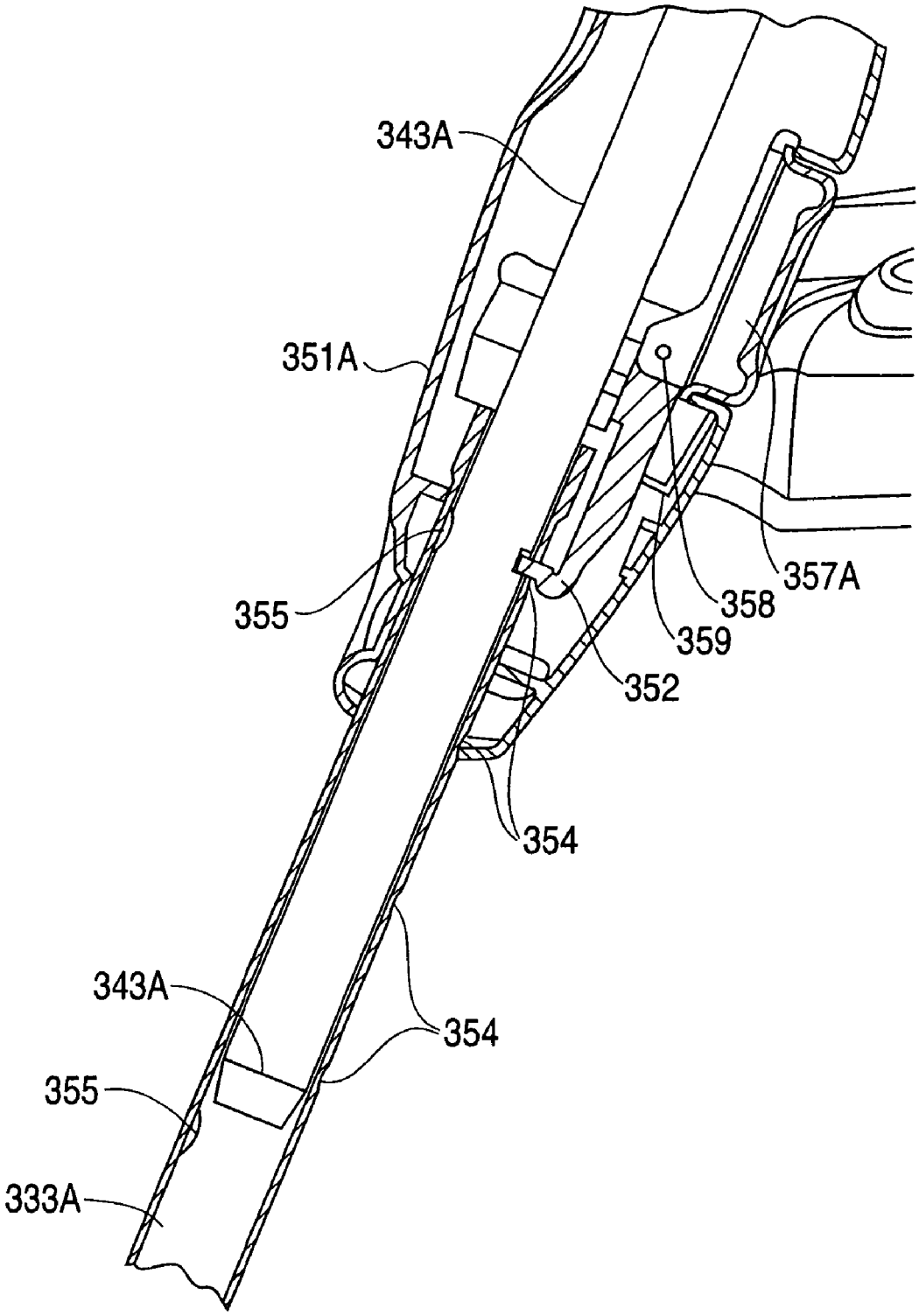
FIG. 11 is a cross-sectional view of the height adjustment mechanism of the device of FIG. 3, taken along section lines 11-11 of FIG. 5.

FIG. 11 is a cross-sectional view of height adjustment mechanism 351A. The functionality of height adjustment mechanism 351A is representative of the remaining height adjustment mechanisms 350A, 350B, 351B. In the illustrated embodiment, first rear mid member 343A is fixedly coupled to height adjustment mechanism 351B. A lower end of first rear mid member 343A is slidably engaged with first end 333A of rear base member 333. By sliding first rear mid member 343A within rear base member 333, the height of the device 300 can be modified.

Locking pin 352 engages an aperture in first rear mid member 343A and one of a plurality of apertures 354 in rear base member 333 to lock the device at a selected height. To release pin 352, release button 357A is pressed. Release button 357A pivots on hinge pin 358 to pull pin 352 away from aperture 354, thus allowing first rear mid member 343A to slide within rear base member 333. Pin 352 is biased by spring 359 in an engaged position. When pin 352 is released and the members 343A, 333 are slid with respect to each other to adjust the height, pin 352 automatically engages the next aperture 354 in rear base member 333. The adjustment range of first rear mid member 343A and rear base member 333 is limited by stops 355 in members 343A, 333 to prevent separation or over-engagement of member 343A, 333.

Each of the height adjustment mechanisms 350A, 350B, 351A, 351B is independently adjustable, but it is desirable for each adjustment mechanism to be set to the same height. When device 300 is in the collapsed configuration, height adjustment mechanisms 350A, 350B, 351A, 351B can also be adjusted to the shortest level to further collapse frame 330 for transport or storage.

Figure 12:
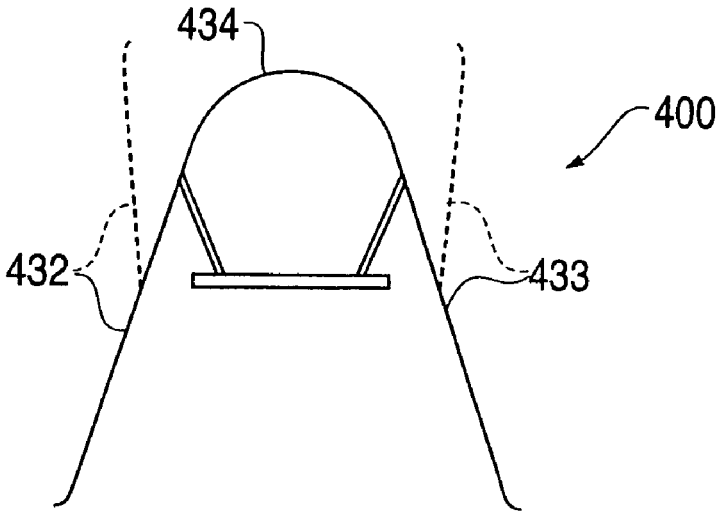
FIG. 12 is a schematic illustration of an alternative embodiment of the device according to the invention.

Several different embodiments are illustrated in FIGS. 12-15 showing alternative frame collapsing and height adjustment configurations. FIG. 12 shows (in a side view) upright members 434 of device 400 folding from the extended configuration to the collapsed configuration (shown in dashed lines). Lower members 432, 433 each fold upward to a location substantially adjacent to upper frame portions 436.

Figure 13:
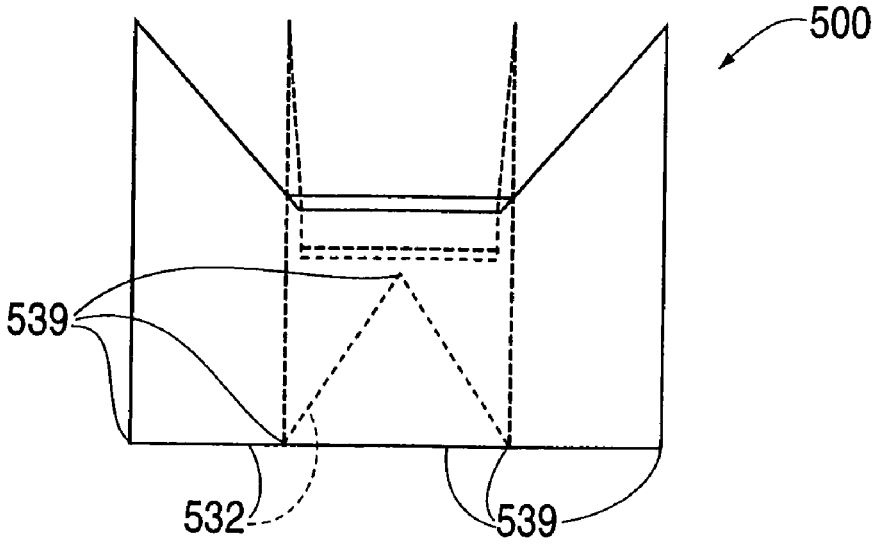
FIG. 13 is a schematic illustration of another alternative embodiment of the device according to the invention.

FIG. 13 shows (in a front view) lower member 532 of device 500 having several hinged portions 539 allowing frame 530 to collapse laterally from the extended configuration to the collapsed configuration (shown in dashed lines) in an accordion-type manner.

Figure 14:
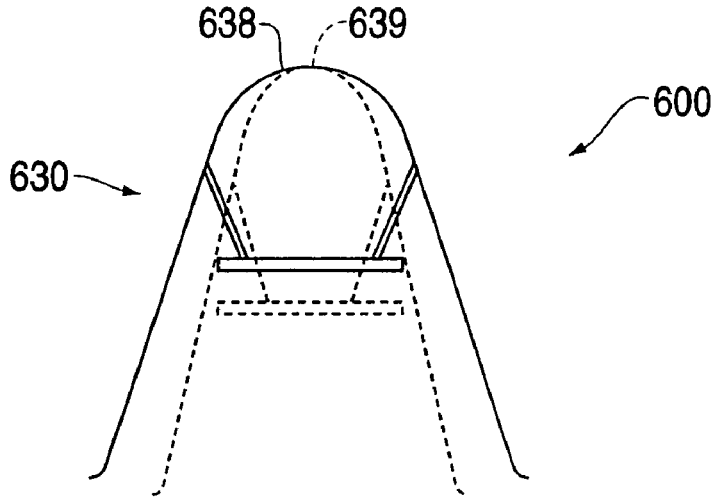
FIG. 14 is a schematic illustration of a further alternative embodiment of the device according to the invention.

FIG. 14 shows (in a side view) hinged portions 639 at apices 638 allowing frame 630 of device 600 to fold from the extended configuration to the collapsed configuration (shown in dashed lines).

Figure 15:
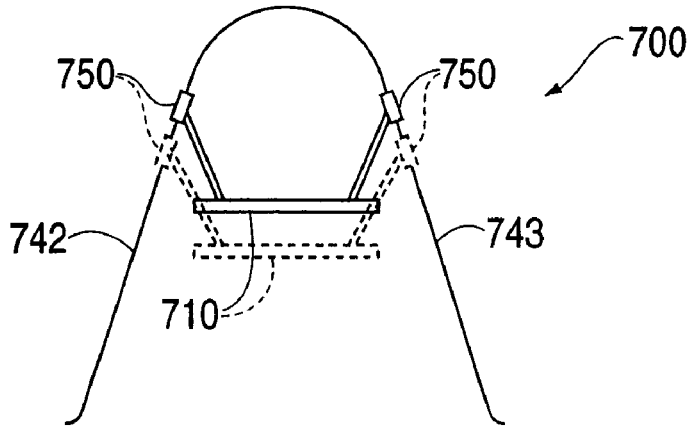
FIG. 15 is a schematic illustration of another alternative embodiment of the device according to the invention.

FIG. 15 shows (in a side view) resilient member connectors 750 having adjustment means for sliding resilient member connectors 750 along mid members 742, 743 to adjust the height of infant seat 710 with respect to a surface supporting device 700.

While particular, illustrative embodiments of the invention have been described, numerous variations and modifications exist that would not depart from the scope of the invention. For example, although the height adjust mechanisms 350A, 350B, 351A, 351B are disclosed above as operating with mid members 342A, 342B, 343A, 343B fixedly attached to the height adjustment mechanism 350A, 350B, 351A, 351B and lower members 332, 333 slidably attached, in alternative embodiments, the lower members 332, 333 could be fixedly attached to one another, with mid members 342A, 342B, 343A, 343B being slidably attached.

Although frame configurations having one and two upright members and one to four resilient members are disclosed above, in alternative embodiments of the invention, several different numbers of upright members and resilient members, (e.g., three upright members with three resilient members, etc.), and alternatives to the illustrated frame configurations exist that do not depart from the scope of the invention.

Although the frame members discussed above are made of tube steel, other appropriate materials such as plastic can be used, and can have any cross-sectional configuration including solid members, square member, I-beam configurations or other shapes and configurations. Similarly hard plastic components such as the resilient member connectors, height adjustment mechanisms, tray, and feet, can be made from other suitable materials such as metal, stiff rubber, etc.

Although the embodiments above show various different frame adjustment/collapsing configurations, any of the features of any of the embodiments can be used with any other embodiment where appropriate (e.g., hinged frame of FIG. 12 can be used with the frame of FIG. 14, etc.).

Although height adjustment mechanisms and resilient member connectors are generally shown as separate components in the embodiments described above, a single component that adjusts the height of the frame and/or seat and collapses the frame can be used.

Although height adjustment mechanism 351A of the embodiment shown in FIG. 11, as described above, shows rear base member end 333A fixedly attached to height adjustment mechanism 351A and mid member 343A extending into rear base member end 333A, in an alternative embodiment, frame members 343A, 333A can be configured to slide past one another to adjust the height and either frame member can be fixedly attached to height adjustment mechanism 351A. Alternatively, the frame members 333A, 343A can be a single, unitary element along which the height adjustment mechanism 351A is configured to slide.

Although several alternatives for collapsing the frame are described above, various combinations in the number and position of hinges, sliding frame members, and other adjustment/collapsing members do not depart from the scope of the invention (e.g., additional pivot joints can be supplied in various locations on the frame).

Although the embodiments above do not specifically discuss electronics, different audio/visual devices and systems can be included. For example, tray 316, including toys 322, can include lights and audio output mechanisms that cause audio and visual feedback (e.g., colors, songs, sounds, etc.) Various actuators could also be employed to detect various movements of portions of a device according to the invention. Lights can be placed around tray 316 or on frame 330 that respond to a predetermined output or movement of infant support 310 with respect to frame 330. Similarly, a speaker can output a music or sounds in response to various inputs.

CONCLUSION

While various embodiments of the invention have been described above, it should be understood that they have been presented by way of example only, and not limitation. Thus, the breadth and scope of the invention should not be limited by any of the above-described embodiments, but should be defined only in accordance with the following claims and their equivalents.

The previous description of the embodiments is provided to enable any person skilled in the art to make or use the invention. While the invention has been particularly shown and described with reference to embodiments thereof, it will be understood by those skilled in the art that various changes in form and details can be made therein without departing from the spirit and scope of the invention.

What is claimed is:

1. A jumper, comprising:

a support frame having:

a first A-shaped frame portion having an apex;

a second A-shaped frame portion having an apex and spaced laterally from said first frame portion;

a ground-engaging portion coupled to each of said first and second frame portions;

a first resilient member having a first end coupled to said first frame portion substantially spaced from said apex of said first frame portion and an opposite, second end;

a second resilient member having a first end coupled to said second frame portion substantially spaced from said apex of said second frame portion and an opposite, second end; and a seat coupled to said second end of each of said resilient members, whereby said seat is suspended from said first frame portion and said second frame portion by said resilient members.

2. The jumper of claim 1, wherein each of said first frame portion and said second frame portion is adjustable in height.

3. The jumper of claim 1, wherein each of said first frame portion and said second frame portion has a first lower end and a second lower end spaced from said apex and is disposable in a first, deployed configuration in which said first lower end is spaced from said second lower end and a second, stowed configuration in which said first lower end is proximate to said second lower end.

4. The jumper of claim 3, wherein said frame is adjustable in height in each of said first, deployed configuration and said second, stowed configuration.

5. The jumper of claim 1, further comprising a third resilient member having a first end coupled to said first frame portion substantially spaced from said apex of said first frame portion and an opposite, second end and wherein said seat is further coupled to said second end of said third resilient member.

6. The jumper of claim 5, further comprising a fourth resilient member having a first end coupled to said second frame portion substantially spaced from said apex of said second frame portion and an opposite, second end and wherein said seat is further coupled to said second end of said fourth resilient member.

7. The jumper of claim 1, wherein a length of said first resilient member and said second resilient member can be adjusted.

8. An apparatus, comprising:

a frame moveable between a retracted configuration and an extended configuration, said frame having:

a first frame member, a second frame member, a connector configured to receive at least a portion of said first frame member and at least a portion of said second frame member, at least one of said first frame member and said second frame member being slidably coupled to said connector;

a seat; and a plurality of resilient members coupled to said frame and said seat to suspend said seat from said frame.

9. The apparatus of claim 8, wherein said connector is a first connector and further comprising a third frame member and a second connector configured to receive at least a portion of said first frame member and at least a portion of said third frame member, at least one of said first frame member and said third frame member being pivotably coupled to the connector.

10. The apparatus of claim 9, wherein said third frame member is substantially V-shaped and is oriented such that the apex of the V is disposed at the upper end of said frame.

11. The apparatus of claim 9, wherein said second frame member is substantially V-shaped and is oriented such that the apex of the V is disposed at the upper end of said frame, at least one of said plurality of resilient members being coupled to said second frame member, substantially spaced from the apex of said second frame member.

12. The apparatus of claim 8, said connector being a first connector and further comprising:

a third frame member, said second frame member and said third frame member being substantially V-shaped and oriented such that the apex of the V is disposed at the upper end of said frame; and a second connector configured to receive at least a portion of said first frame member and at least a portion of said fourth frame member, at least one of said first frame member and said fourth frame member being slidably coupled to said second connector.

13. The apparatus of claim 12, further comprising a fourth frame member, said first frame member and said fourth frame member being substantially U-shaped and configured to support said frame on a support surface.

14. The apparatus of claim 12, wherein said first connector and said second connector are configured to adjust the height of said seat with respect to a support surface.

15. An apparatus, comprising:

a frame moveable between a first configuration and a second configuration, said frame having:

a first front leg having a first hinged portion, a second front leg having a second hinged portion, the first front leg and the second front leg being extended in the first configuration, and the first front leg and the second front leg being folded in the second configuration;

a seat;

a plurality of height adjustment members configured to adjust a height of said seat with respect to a support surface; and a plurality of resilient members disposed between said frame and said seat.

16. The apparatus of claim 15, wherein said plurality of height adjustment members adjust the height of said frame.

17. The apparatus of claim 15, wherein said first front leg and said second front leg are portions of a continuous front frame member.

18. The apparatus of claim 15, said frame further having a first upper member and a second upper member, each of said first and second upper members being substantially V-shaped with an apex, said first upper member being coupled to said first front leg, said second upper member being coupled to said second front leg.

19. The apparatus of claim 18, wherein at least one of said plurality of resilient members is coupled to said first upper member substantially spaced from the apex of said first upper member, and at least one of said plurality of resilient members is coupled to said second upper member substantially spaced from the apex of said second upper member.

20. The apparatus of claim 15, wherein at least one of said plurality of height adjustment members is disposed on each of said first front leg, and said second front leg.

* * * * *